US006556101B1

(12) United States Patent
Tada et al.

(10) Patent No.: US 6,556,101 B1
(45) Date of Patent: Apr. 29, 2003

(54) DIELECTRIC RESONATOR, DIELECTRIC FILTER, DIELECTRIC DUPLEXER, AND COMMUNICATION DEVICE

(75) Inventors: Hitoshi Tada, Ishikawa-ken (JP); Hideyuki Kato, Ishikawa-ken (JP); Haruo Matsumoto, Kanazawa (JP)

(73) Assignee: Murata Manufacturing Co. Ltd. (JP)

( * ) Notice: Subject to any disclaimer, the term of this patent is extended or adjusted under 35 U.S.C. 154(b) by 2 days.

(21) Appl. No.: 09/707,264

(22) Filed: Nov. 6, 2000

(30) Foreign Application Priority Data

Nov. 5, 1999 (JP) ..... 11-314658
Aug. 25, 2000 (JP) ..... 2000-256191

(51) Int. Cl.[7] ..... H01P 1/202; H01P 1/20; H01P 1/213

(52) U.S. Cl. ..... 333/134; 333/206; 333/222
(58) Field of Search ..... 333/202, 206, 333/134, 222

(56) References Cited

U.S. PATENT DOCUMENTS

| | | | |
|---|---|---|---|
| 2,797,392 A | 6/1957 | Clogston | 333/236 |
| 2,831,921 A | 4/1958 | Morgan | 178/45 |

FOREIGN PATENT DOCUMENTS

| | | |
|---|---|---|
| EP | 0716468 | 6/1996 |
| EP | 0869572 A2 | 10/1998 |
| JP | 8167804 | 6/1996 |
| JP | 8191208 | 7/1996 |
| JP | 9-93005 | 4/1997 |
| JP | 10220302 | 8/1998 |

OTHER PUBLICATIONS

European Search Report dated Jan. 30, 2002.

*Primary Examiner*—Robert Pascal
*Assistant Examiner*—Stephen E. Jones
(74) *Attorney, Agent, or Firm*—Dickstein, Shapiro, Morin & Oshinsky, LLP.

(57) ABSTRACT

A small-sized low-loss dielectric resonator, dielectric filter, and dielectric duplexer, and a communication device using such an element. Through-holes are formed in a dielectric block. The inner surface of each through-hole is covered with a thin-film multilayer electrode consisting of an outermost conductive layer and a multilayer region including thin-film conductive layers and thin-film dielectric layers. An outer conductor having a similar thin-film multilayer electrode structure is formed on the outer surface of the dielectric block. An outer conductor in the form of a single-layer electrode is formed on a short-circuited end face of the dielectric block thereby connecting together the thin-film conductive layers of the inner and outer conductors.

12 Claims, 12 Drawing Sheets

FIG. 8D
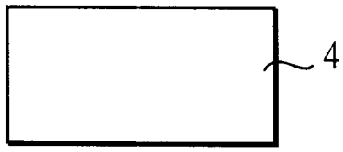
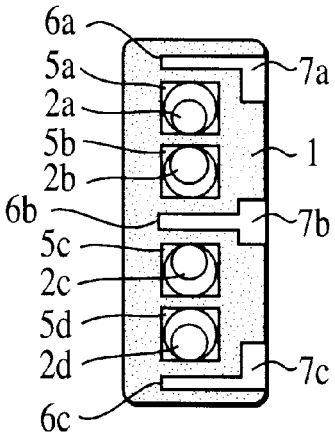
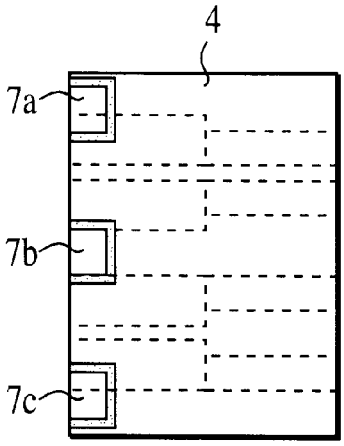
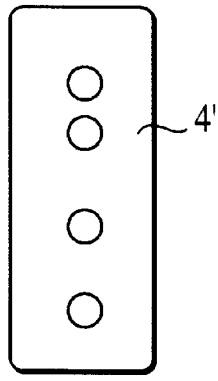
FIG. 8B FIG. 8A FIG. 8C

FIG. 10D
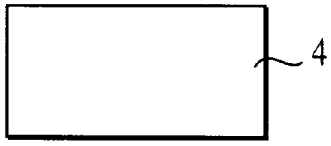
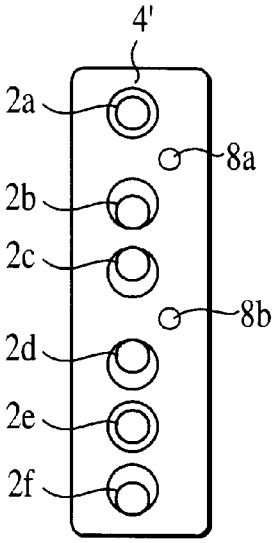
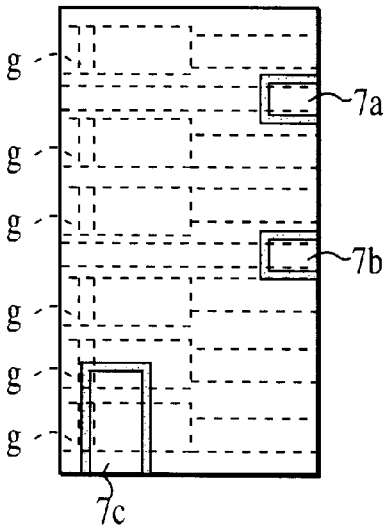
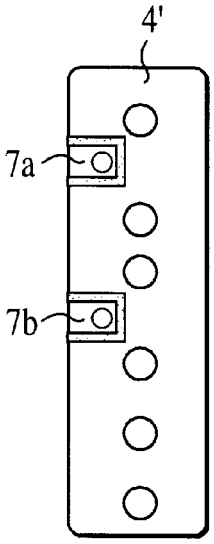
FIG. 10B FIG. 10A FIG. 10C
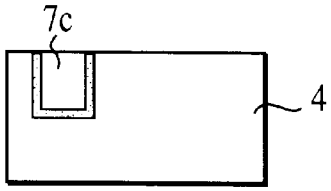
FIG. 10E

DIELECTRIC RESONATOR, DIELECTRIC FILTER, DIELECTRIC DUPLEXER, AND COMMUNICATION DEVICE

BACKGROUND OF THE INVENTION

1. Field of the Invention

The present invention relates to a dielectric resonator, a dielectric filter, and a dielectric duplexer, which include a dielectric block and conductive layers serving as electrodes formed on the inner and outer surfaces of the dielectric block, and also to a communication device using at least one of the dielectric resonator, the dielectric filter, and the dielectric duplexer.

2. Description of the Related Art

A typical dielectric resonator for use in the microwave band is formed using a rectangular or cylindrical dielectric block having a coaxial through-hole wherein an inner conductor is formed on the inner surface of the through-hole and an outer conductor is formed on the outer surface of the dielectric block. It is also known in the art to construct a dielectric filter or a dielectric duplexer having a plurality of resonator stages by forming a plurality of through-holes in a rectangular dielectric block and forming inner conductors on the inner surfaces of the respective through-holes thereby forming a plurality of dielectric resonators in the single dielectric block.

Devices such as the dielectric resonator and the dielectric filter constructed by forming conductive films serving as electrodes on the inner and outer surfaces of a dielectric block have the advantages that the total size is small and high unloaded Q (Qo) is obtained.

However, when this type of device is used in a circuit which deals with rather high power, as is the case with a transmission filter or a dielectric duplexer used as an antenna duplexer, it is desired to further reduce the loss of the dielectric resonator or the insertion loss of the dielectric filter so as to meet the requirements of reducing the size and power consumption of electronic devices.

Thus, the present invention provides a dielectric resonator, a dielectric filter, and a dielectric duplexer, which are small in size and have reduced loss.

SUMMARY OF THE INVENTION

In general, the loss in a dielectric resonator includes conductor losses in conductive films such as an inner conductor and an outer conductor, a dielectric loss in a dielectric material, and a radiation loss due to energy radiated to the outside. Of these losses, the conductor loss is dominant. Therefore, the key point for reducing losses in dielectric resonators is to reduce the conductive loss.

To reduce the conductor loss, it is effective to form electrodes using a material having high conductivity and to increase the film thickness of the electrodes. However, at high frequencies such as microwave-band frequencies, the current is concentrated by the skin effect in a surface region with a skin depth dependent upon the operating frequency. Therefore, the increase in the thickness of the conductive film beyond the skin depth results in substantially no further reduction in the conductor loss.

If the size of the dielectric block is increased, and if a dielectric material having a small dielectric constant is employed to form the dielectric block, the conductive films will have a reduced current density, and thus the conductive loss will be reduced. However, this technique cannot meet the requirement of reducing the size of the resonator.

In view of the above, the present invention provides a dielectric resonator comprising a dielectric block, an inner conductor formed on the inner surface of a through-hole extending from one end face to the opposite end face of the dielectric block, and an outer conductor formed on the outer surface of the dielectric block, wherein at least a part of at least one of the inner conductor and the outer conductor has a thin-film multilayer electrode structure formed by alternately disposing thin-film conductive layers with a thickness smaller than the skin depth at the operating frequency and thin-film dielectric layers with a particular dielectric constant, thereby allowing currents to be passed substantially equally through the respective thin-film conductive layers of the thin-film multilayer electrodes and thus achieving an increase in the effective area (effective cross section) of the respective current paths and a reduction in the total conductor loss. As a result, a dielectric resonator with a low loss is achieved.

The present invention also provides a dielectric filter comprising the dielectric block described above and external terminals serving as high frequency signal input/output terminals. Herein, the dielectric block preferably includes a plurality of through-holes, and the inner conductors formed on the inner surfaces of the through-holes preferably have the thin-film multilayer electrode structure at locations where they are closest to each other. In this structure at locations where they are closest to each other, the thin-film multilayer electrodes are provided at locations where the electric field is concentrated in the odd mode of the coupling modes of the two resonators, thereby efficiently improving the insertion loss of the dielectric filter.

The present invention also provides a dielectric duplexer comprising the dielectric block described above, an external terminal for connection with an antenna, an external terminal for connection with a receiving circuit, and an external terminal for connection with a transmitting circuit, wherein the external terminals are disposed on the outer surface of the dielectric block. This dielectric duplexer using the single dielectric block may be employed, for example, as an antenna duplexer having a transmission filter and a reception filter.

The present invention also provides a communication device including the above-described dielectric filter serving, for example, as a transmission/reception signal band-pass filter or including the above-described dielectric duplexer serving as an antenna duplexer. Thus, a communication device having a small size and having a high power efficiency can be realized.

Other features and advantages of the present invention will become apparent from the following description of the invention which refers to the accompanying drawings, in which like references denote like elements and parts.

BRIEF DESCRIPTION OF THE DRAWINGS

FIGS. 8A–8D provide a projection view of a dielectric duplexer according to a sixth embodiment of the present invention;

FIGS. 10A–10E provide a projection view of a dielectric duplexer according to a seventh embodiment of the present invention;

DESCRIPTION OF EMBODIMENTS OF THE INVENTION

The structure of a dielectric resonator according to a first embodiment is described below with reference to FIGS. 1A, 1B and 2.

Figure 1A:
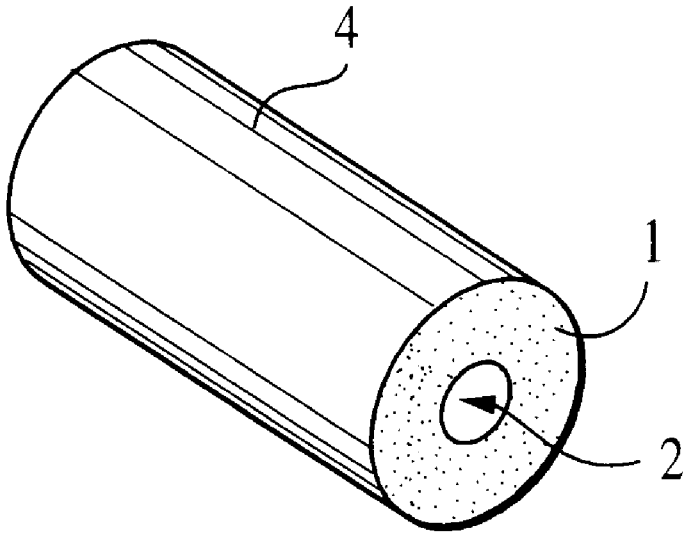
FIGS. 1A and 1B illustrate the structure of a dielectric resonator according to a first embodiment of the present invention.
Figure 1B:
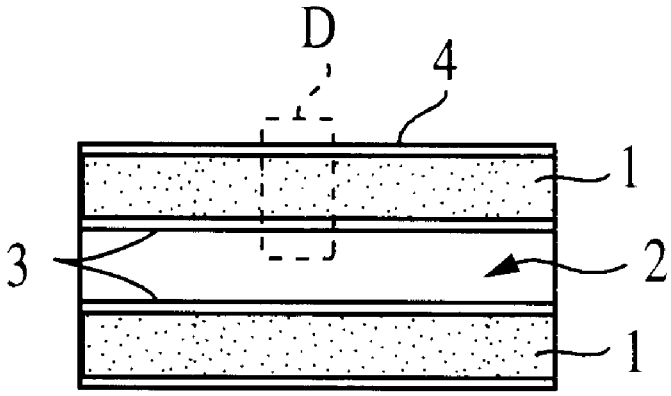

FIG. 1A is a perspective view illustrating the appearance of the dielectric resonator, and FIG. 1B is a cross-sectional view thereof taken along the central axis. In these figures, reference numeral 1 denotes a cylindrical-shaped dielectric block having a through-hole 2 extending along the central axis from one end face to the opposite end face. An inner conductor 3 is formed on the inner surface of the through-hole 2, and an outer conductor 4 is formed on the outer surface of the dielectric block 1. As will be described later, the inner conductor 3 and the outer conductor 4 are both formed so as to have a thin-film multilayer electrode structure consisting of a plurality of thin-film conductive layers and thin-film dielectric layers which are alternately disposed one on another.

Figure 2:
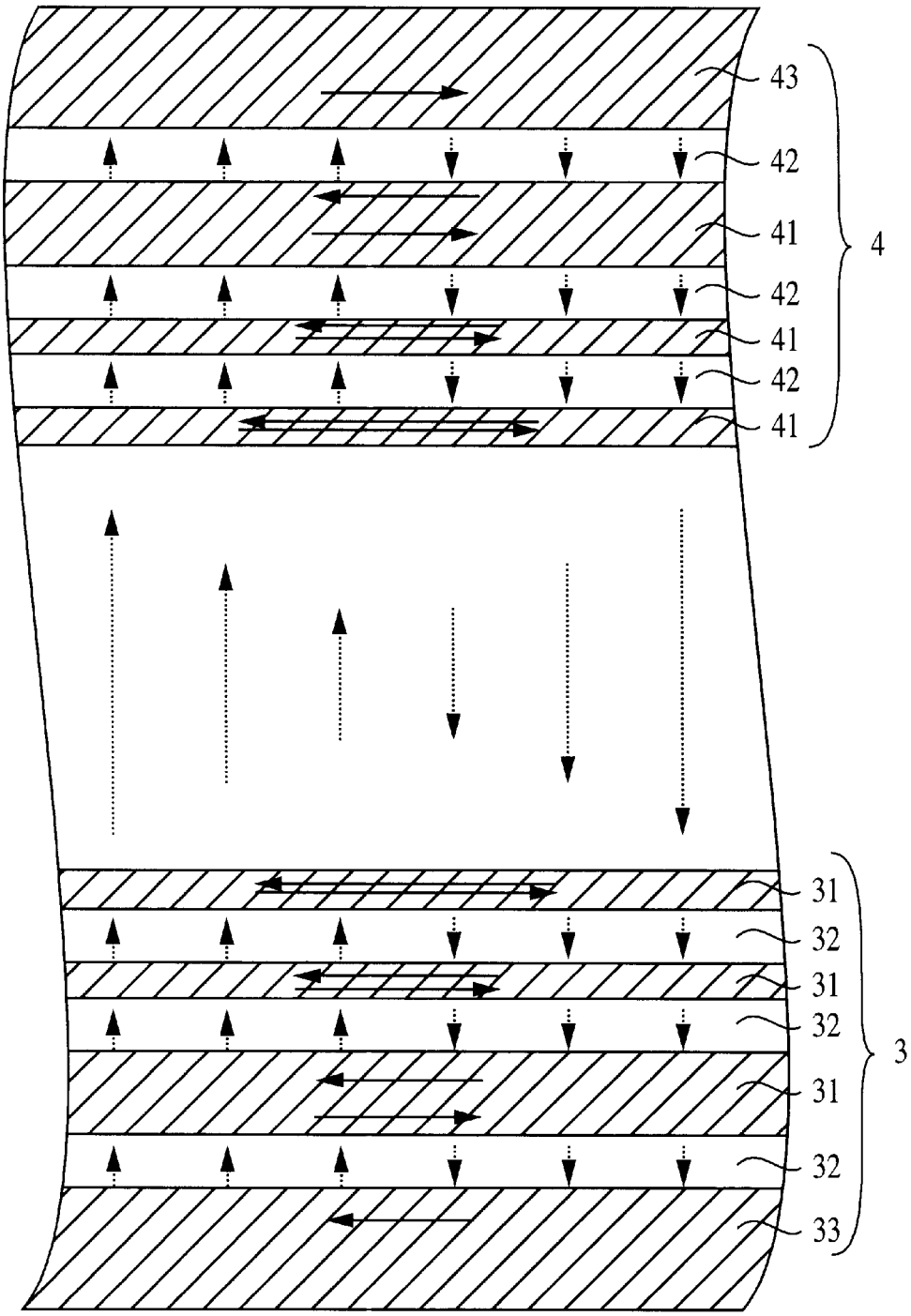
FIG. 2 is a schematic diagram illustrating an example of a current distribution in a main part of the dielectric resonator.

FIG. 2 is a cross-sectional view of a part denoted by D in FIG. 1B. Note that in FIG. 2 the thickness of the dielectric block 1 is much reduced relative to the thicknesses of the thin-film conductive layers. In FIG. 2, solid arrows represent high frequency currents and broken arrows represent displacement currents. Reference numerals 31 and 41 denote thin-film conductive layers with a thickness equal to or smaller than the skin depth at the operating frequency, which may be equal or unequal in thickness. Reference numerals 32 and 42 denote thin-film dielectric layers with a particular dielectric constant (for example, $\epsilon_r$=4 to 20). Reference numerals 33 and 43 denote outermost conductive layers. The inner conductor 3 and the outer conductor 4 with the thin-film multilayer electrode structure are produced by alternately disposing thin-film conductive layers and thin-film dielectric layers. The outermost conductive layers are formed so as to have a large thickness thereby achieving ruggedness of the surfaces of the thin-film multilayer electrodes. This allows the multilayer structure made up of the thin-film conductive layers and the thin-film dielectric layers to be maintained without being deformed when a pin electrode is inserted into the though-hole 2 so as to achieve electrical connection with the inner conductor 3, or when the outer electrode 4 of the dielectric resonator is soldered to a ground electrode on a mounting substrate. More specifically, for example, the numbers of thin-film conductive layers and thin-film dielectric layers may be 2, the thickness of each thin-film conductive layer may be 1823 nm, the thickness of each dielectric layer may be 113 nm, and the thickness of each outermost conductive layer may be 6000 nm, although specific values may be varied depending upon the operating frequency.

U.S. patent application Ser. No. 08/604,952 (based on WO95/06336), filed Feb. 27, 1996, allowed, assigned to Murata Manufacturing Co., Ltd. discloses in detail a method for designing the thin-film multilayer electrode structure. Its disclosure is hereby incorporated by reference.

If a high frequency signal is applied between the outermost conductive layers 33 and 43, a high frequency electric field is applied across the dielectric block 1 as shown in FIG. 2, and resonance occurs. The high-frequency electric power applied, via thin-film dielectric layers at lower positions, to the respective thin-film conductive layers 31 and 41 is partially transmitted to thin-film conductive layers located at upper positions, and the energy of the high-frequency signal is partially reflected back to the thin-film conductive layers at the lower positions via the thin-film dielectric layers at the lower positions. In each thin-film dielectric layer located between two adjacent thin-film conductive layers, the reflected and transmitted waves resonate, and high-frequency currents flow in the upper surface region and the lower surface region of each thin-film conductive layer such that they flow along the surfaces in parallel but in opposite directions. Because the film thicknesses of the thin-film conductive layers 31 and 41 are smaller than the skin depth, the two high-frequency currents flowing in parallel in the opposite directions interfere with each other via the thin-film dielectric layer. As a result, almost all currents are cancelled.

On the other hand, in the thin-film dielectric layers 32 and 42, displacement currents are generated by electromagnetic fields. As a result, high-frequency currents are generated in the surfaces of the thin-film conductive layers directly adjacent to the thin-film dielectric layers 32 and 42. In this first embodiment, the dielectric resonator acts as a half-wave coaxial resonator which is open-circuited at both ends, and thus the displacement currents become maximum at both ends, in the longitudinal direction, of the inner conductor 3 and become minimum at the center thereof.

The thicknesses of the respective thin-film dielectric layers 32 and 42 are selected so that the phase velocities of TEM waves propagating through the dielectric block 1 and the thin-film dielectric layers 32 and 42 become substantially equal. Therefore, the high-frequency currents flowing in a distributed fashion through the thin-film conductive layers 31 and 41 become equal in phase. This results in an increase in the effective skin depth.

As described above, the increased effective skin depth is obtained by distributing the currents among the thin-film conductive layers 31 and 41 such that the distributed currents flow with the same phase. As a result, the effective areas (effective cross sections) of the current paths are increased and thus the conductor losses are reduced. Thus, a dielectric resonator with a low loss is obtained.

Although in the present embodiment both inner and outer conductors are formed so as to have the thin-film multilayer electrode structure, only the outer conductor or the inner conductor may have the thin-film multilayer electrode structure.

The structure of a dielectric resonator according to a second embodiment is described below with reference to FIGS. 3A–3C.

Figure 3A:
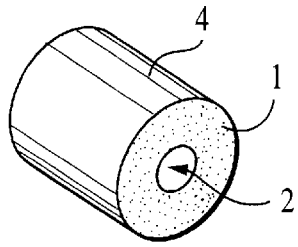
FIGS. 3A–3C illustrate the structure of a dielectric resonator according to a second embodiment of the present invention.
Figure 3B:
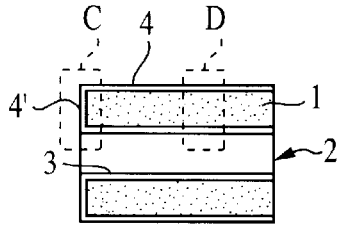
Figure 3C:
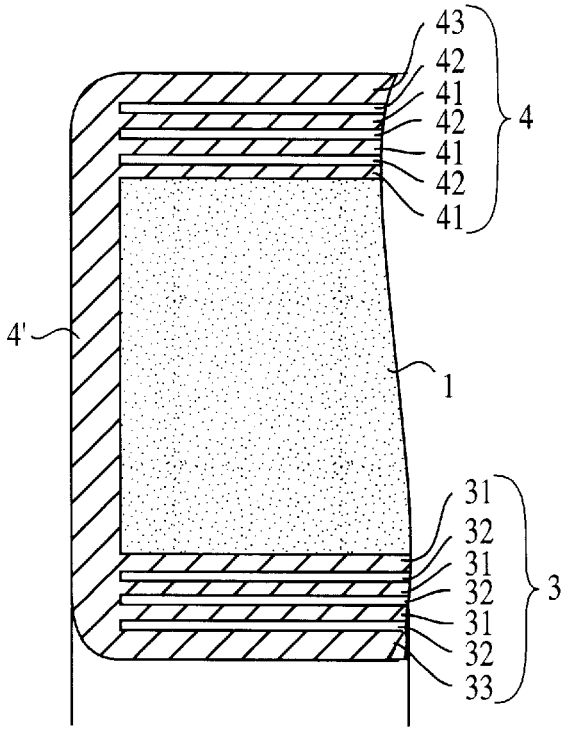

FIG. 3A is a perspective view illustrating the appearance of the dielectric resonator, and FIG. 3B is a cross-sectional view thereof taken along the central axis. FIG. 3C is an enlarged view of a part denoted by C in FIG. 3B. In this embodiment, unlike the first embodiment described above with reference to FIGS. 1A–1B, one end face, on a front side in FIG. 3A, of a dielectric block 1 is formed so as to act as an open-circuited end, and the opposite end face is formed so as to act as a short-circuited end. An inner conductor 3 and an outer conductor 4 are formed on the inner surface of a through-hole 2 and the outer surface of the dielectric block 1, respectively, in a similar manner to the first embodiment. A part denoted by D in FIG. 3B has an electrode structure similar to that shown in FIG. 2, although the distributions of currents and displacement currents are different. An outer conductor 4' in the form of a single-layer electrode is disposed on the short-circuited end face of the dielectric block 1 such that an end of the inner conductor 3 with the thin-film multilayer electrode structure and an end of the outer conductor 4 with the thin-film multilayer electrode structure are electrically connected to each other via the outer conductor 4'. The outer conductor 4' connects together the thin-film conductive layers 31 and the outermost conductor layer 33 of the inner conductor 3 and also connects together the thin-film conductive layers 41 and the outermost conductive layer 43 of the outer conductor 4.

As a result of connecting together the respective conductive layers of the thin-film multilayer electrodes at the short-circuited end, the respective thin-film conductive layers have a common potential of zero, and high-frequency currents flowing through the respective thin-film conductive layers have the same phase. Thus, as in the first embodiment, the effective skin depth is increased. Herein, the conductor loss of the outer conductor 4' can be minimized by forming the outer conductor 4' so as to have a thickness equal to or greater than the skin depth at the operating frequency.

Because the outer conductor 4' on the short-circuited end face is in the form of a single-layer electrode, it is possible to adjust the resonance frequency of the dielectric resonator simply by cutting a part of the outer conductor 4' by a particular amount.

The structure of a dielectric filter according to a third embodiment is described below with reference to FIGS. 4, 5A and 5B.

Figure 4:
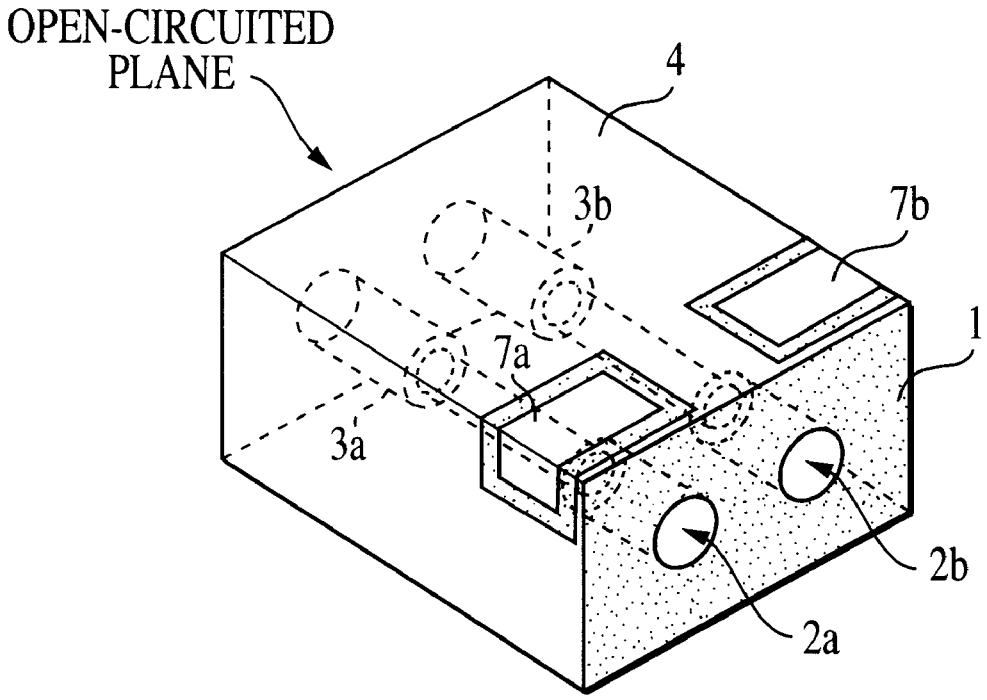
FIG. 4 is a perspective view illustrating the appearance of a dielectric filter according to a third embodiment of the present invention.

FIG. 4 is a perspective view illustrating the appearance of the dielectric filter. Note that the dielectric filter is drawn such that the plane to be in contact with a mounting substrate is on the top side of FIG. 4. In FIG. 4, reference numeral 1 denotes a rectangular dielectric block. In the dielectric block 1, through-holes 2*a* and 2*b* are formed between two opposite end faces such that the axes thereof become parallel to each other. The through-holes 2*a* and 2*b* have a stepped structure in terms of the hole diameter along the axis thereof. That is, the through-hole 2*a* and 2*b* includes a small-diameter part with a small hole diameter formed in the center and large-diameter parts with a large hole diameter formed on both end sides. Inner conductors 3*a* and 3*b* are formed on the inner surfaces of the respective through-holes 2*a* and 2*b*. On the outer surface of the dielectric block 1, an outer conductor 4 is formed on four side faces other than the two end faces between which the through-holes 2*a* and 2*b* are formed. Furthermore, signal input/output terminals 7*a* and 7*b* for inputting/outputting a high frequency signal are formed on the outer surface of the dielectric block 1 such that they are electrically isolated from the outer conductor 4.

Figure 5A:
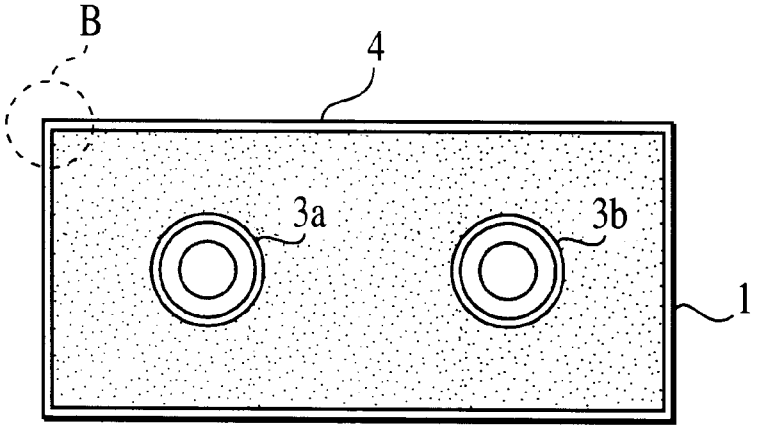
FIGS. 5A and 5B are views of the dielectric filter shown in FIG. 4, seen from the side of one end face in which open ends of through-holes are formed, wherein an enlarged view of a part of the dielectric filter is also shown.
Figure 5B:
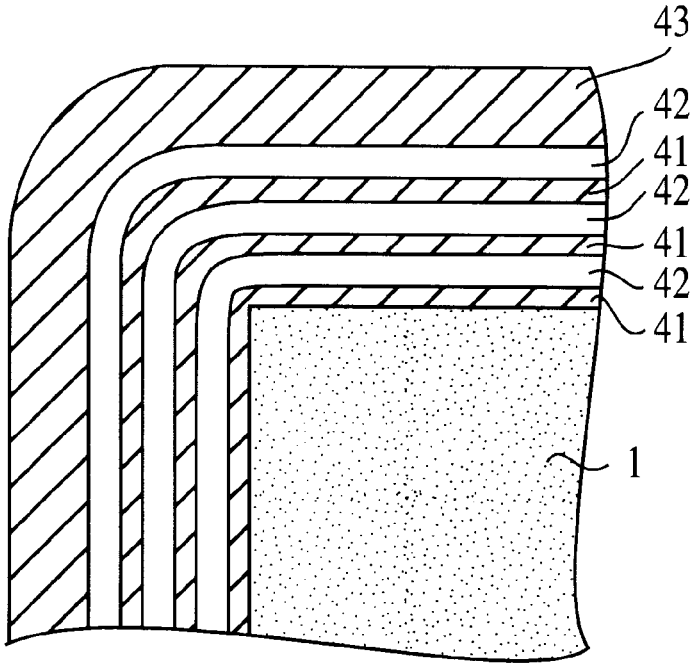

FIG. 5A is a view of the dielectric filter shown in FIG. 4, seen from the side of one end face in which open ends of the through-holes 2*a* and 2*b* are formed. FIG. 5B is an enlarged view of a part denoted by B in FIG. 5A. As can be seen, the outer conductor 4 has a thin-film multilayer electrode structure consisting of an outermost conductive layer 43 and a multilayer region including thin-film conductive layers 41 and thin-film dielectric layers 42. As shown in FIG. 5B, the thin-film conductive layers 41 and the thin-film dielectric layers 42 extend continuously along a ridge from one side face of the dielectric block 1 to another adjacent side face. The inner conductors 3*a* and 3*b* also have a thin-film multilayer electrode structure similar to that shown in FIG. 2. Thus, two half-wave resonators coupled to each other are formed in the single dielectric block.

The signal input/output terminals 7*a* and 7*b* are formed by first forming the thin-film multilayer electrode over the entire areas of the four side faces of the dielectric block 1 and then selectively etching the thin-film multilayer electrode so as to form portions isolated from the remainder of the outer conductor 4. The signal input/output terminals 7*a* and 7*b* create electrostatic capacitance with respective open ends of the inner conductors 3*a* and 3*b*, and thus the signal input/output terminals 7*a*and 7*b* are capacitively coupled with the respective resonators. The signal input/output terminals 7*a* and 7*b* may be formed so as to have a thin-film multilayer electrode structure, like the outer conductor 4, or may be formed so as to have a single-layer electrode structure because the signal input/output terminals 7*a* and 7*b*have a small current density.

The structure of a dielectric filter according to a fourth embodiment is described below with reference to FIGS. 6A–6B.

Figure 6A:
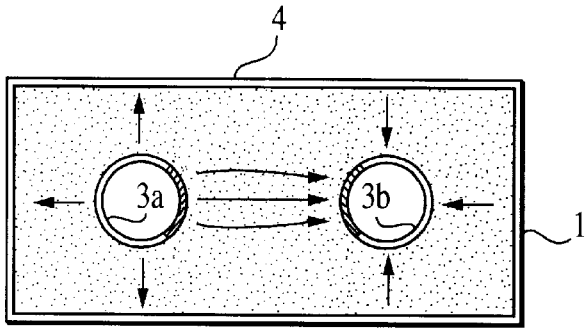
FIGS. 6A and 6B are cross-sectional views illustrating the structure of a dielectric resonator according to a fourth embodiment of the present invention.
Figure 6B:
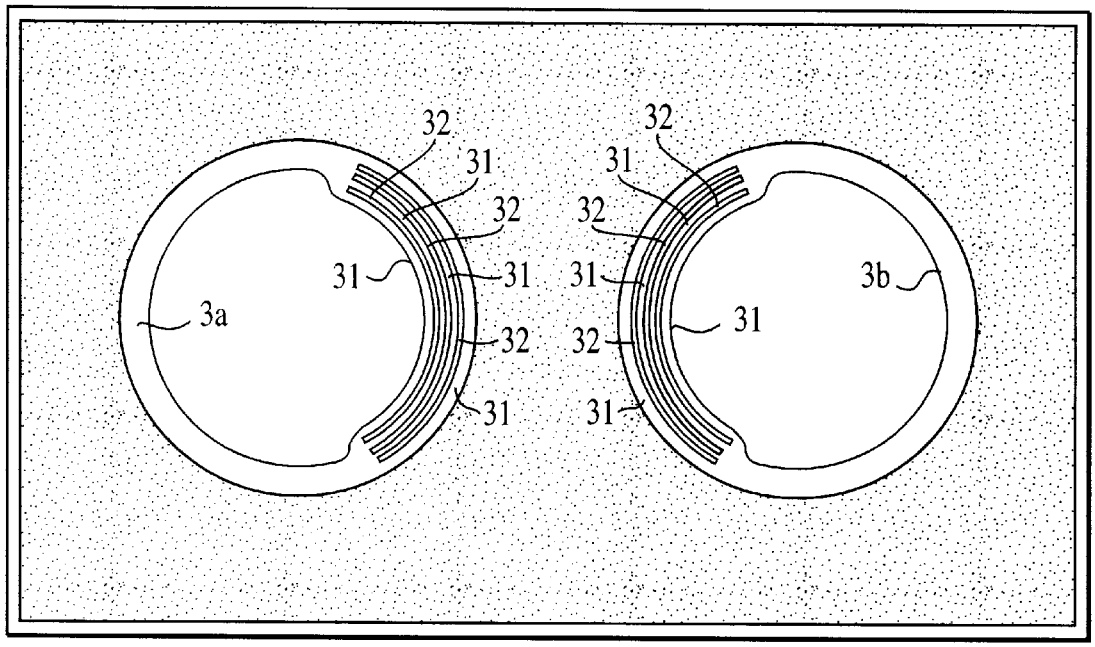

FIG. 6A is a view of one end face of the dielectric filter in which open ends of two through-holes are formed. FIG. 6B is a cross-sectional view of the dielectric filter, taken along a plane perpendicular to the axes of the through-holes. In FIG. 6A, solid arrows represent lines of electric force in an odd mode thereby representing the electric field distribution. In the odd mode, as can be seen, the part between the two inner conductors 3*a* and 3*b* acts as an electrical wall, and thus an electric field is concentrated in regions where the inner conductors 3*a* and 3*b* are closest to each other (such as regions along a plane defined by the longitudinal axes of the inner conductors 3*a* and 3*b*). As a result, the current density becomes high in these regions. In view of the above, the inner conductors are formed such that the regions of the inner conductors where the current density becomes high, that is, the closest parts of the inner conductors, have a thin-film multilayer electrode structure, as shown in FIG. 6B. That is, in FIG. 6B, reference numerals 31 and 32 denote thin-film conductive layers and thin-film dielectric layers, respectively, making up thin-film multilayer electrodes. In this structure, the current distribution in the opposing parts of the thin-film multilayer electrodes of the two inner conductors 3*a* and 3*b* along the axis in the odd mode is similar to that shown in FIG. 2. Thus, the effective skin depth of the inner conductors 3*a* and 3*b* is increased, and the conductive loss of the inner conductors is reduced.

The structure of a dielectric filter according to a fifth embodiment is described below with reference to FIGS.

Figure 7A:
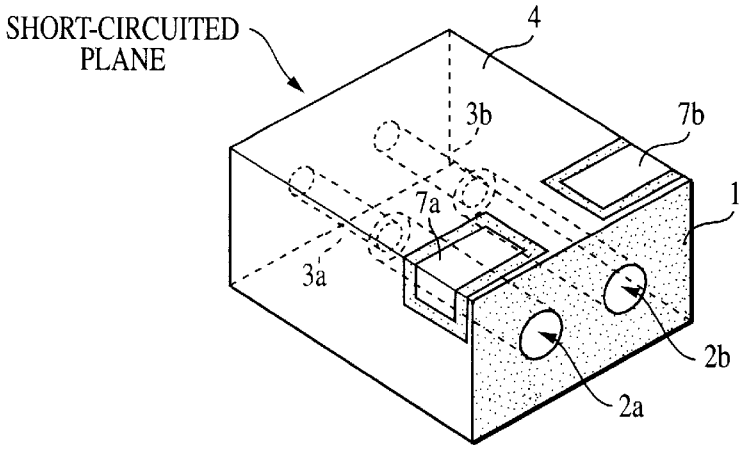
FIGS. 7A–7C are views illustrating the structure of a dielectric resonator according to a fifth embodiment of the present invention.
Figure 7B:
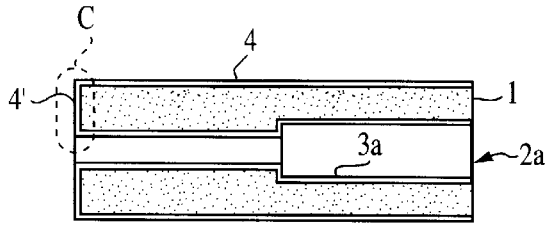
Figure 7C:
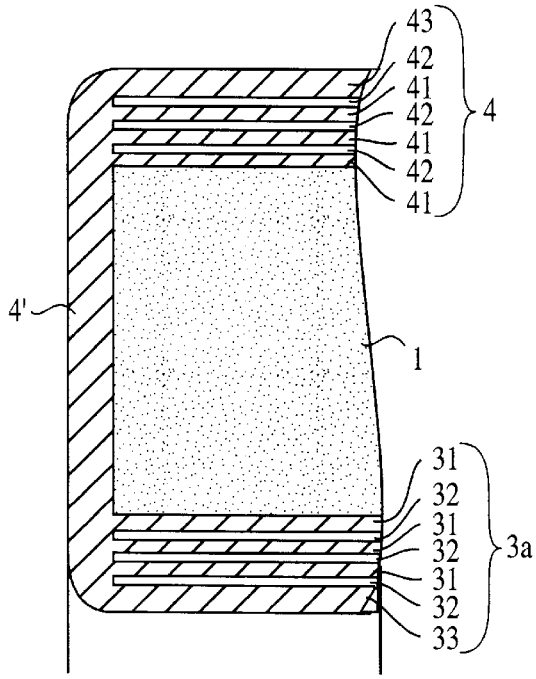

7A–7C. FIG. 7A is a perspective view illustrating the appearance of the dielectric filter, and FIG. 7B is a cross-sectional view thereof, taken along the central axis of one of two through-holes. FIG. 7C is an enlarged view of a part denoted by C in FIG. 7B. In this embodiment, through-holes 2*a* and 2*b* whose inner surface is covered with an inner conductor are formed in a dielectric block 1, and an outer conductor 4 and signal input/output terminals 7*a* and 7*b* are formed on the outer surface of the dielectric block 1. In this embodiment, unlike the dielectric filter shown in FIG. 4, one end of each through-hole 2*a* and 2*b* is formed so as to act as an open-circuited plane and the opposite end is formed so as to act as a short-circuited plane. Each through-hole 2*a* and 2*b* includes a large-diameter part with a large internal diameter located at the open-circuited end and a small-diameter part with a small internal diameter located at the short-circuited end.

An outer conductor 4' in the form of a single-layer electrode with a thickness equal to or greater than 3 times the skin depth at the operating frequency is disposed on the short-circuited side face of the dielectric block 1 such that the inner conductor 3*a* and the outer conductor 4 with the thin-film multilayer electrode structure are electrically connected to each other and the respective thin-film conductive layers are also connected together. The other inner conductor 3*b* is also electrically connected in a similar manner.

By forming the quarter-wave resonators in the single dielectric block in the above-described manner, a dielectric filter having a band-pass characteristic is obtained.

Although in this fifth embodiment, the through-holes are formed such that only one end of each through-hole acts as the short-circuited plane, the through-holes may also be formed such that both ends of each through-hole act as short-circuited planes thereby forming resonators in which half-wave resonance occurs at both short-circuited ends.

The structure of a dielectric duplexer according to a sixth embodiment is described below with reference to FIGS. 8A–9B.

FIGS. 8A–8D show a projection view of the dielectric duplexer, wherein a top view, a left side view, a right side view, and a rear view are given in FIGS. 8A, 8B, 8C, and 8D, respectively. Note that the upper surface shown in FIG. 8A is a surface to be in contact with a mounting substrate. As shown in FIG. 8A, substantially parallel though-holes 2*a* to 2*d* are formed in a dielectric block 1 having a generally rectangular shape. An inner conductor having a thin-film multilayer electrode structure is formed on the inner surface of each through-hole. An outer conductor 4 having a thin-film multilayer electrode structure is formed on the four side faces, parallel to the axes of the through-holes, of the dielectric block 1. An outer conductor 4' in the form of a single-layer electrode is disposed on an end face, serving as a short-circuited plane, of the dielectric block 1. On the open-circuited end face of the dielectric block 1, open-end electrodes 5*a* to 5*d* are formed which extend continuously from the respective inner conductors. On this open-circuited end face, coupling electrodes 6*a*, 6*b*, and 6*c* capacitively coupled with adjacent open-end electrodes are also formed. Furthermore, signal input/output terminals 7*a*, 7*b*, and 7*c* are formed on this open-circuited end face of the dielectric block 1 such that they continuously extend from the respective coupling electrodes 6*a*, 6*b*, and 6*c* and further to the upper surface, and such that they are electrically isolated from the outer conductor 4.

Figure 9A:
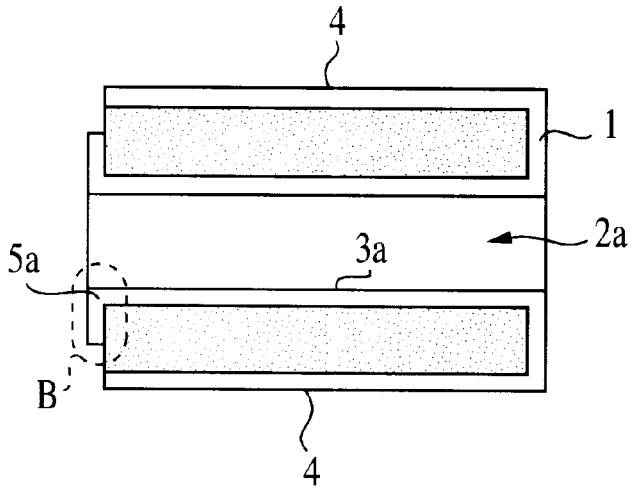
FIGS. 9A and 9B are cross-sectional views of the dielectric duplexer according to the sixth embodiment, wherein an enlarged view of a part thereof is also shown.
Figure 9B:
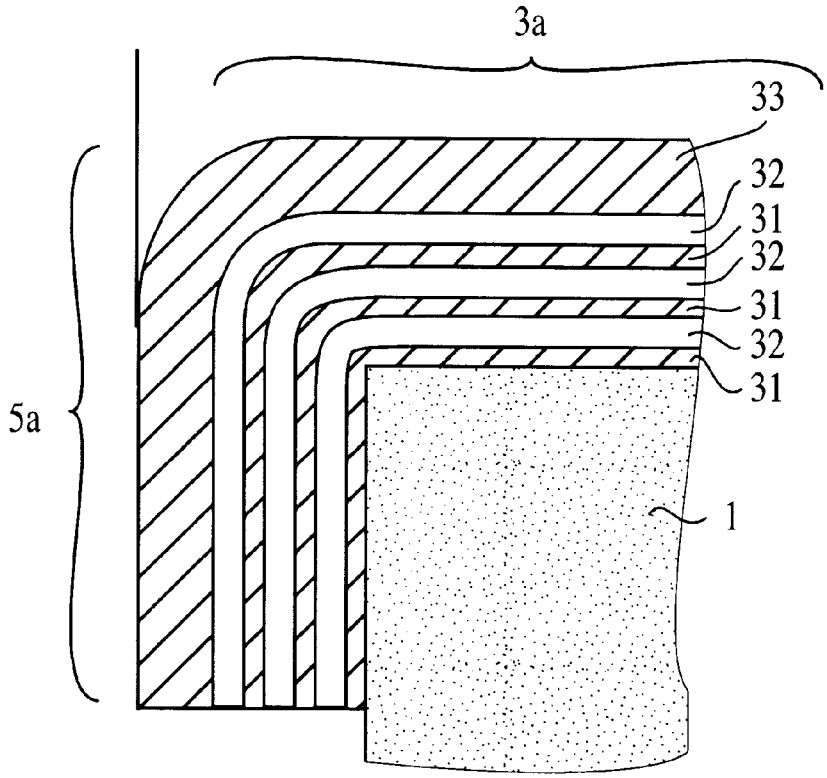

FIG. 9A is a cross-sectional view of the dielectric duplexer, taken along a plane in which the axis of the through-hole 2*a* lies and which is perpendicular to the upper surface of the dielectric block 1. FIG. 9B is an enlarged view of a part denoted by B in FIG. 9A. As shown in FIG. 9B, the inner conductor 3*a* is formed so as to have a thin-film multilayer electrode structure consisting of thin-film conductive layers 31, thin-film dielectric layers 32, and an outermost conductive layer 33. The open-end electrode 5*a* also has a thin-film multilayer electrode structure each layer of which extends continuously to the end face of the dielectric block 1.

Because the respective thin-film conductive layers of the open-end electrode extending from the inner conductor are maintained open-circuited at the open-circuited end without being connected together, high frequency currents flowing through the respective thin-film conductive layers 31 and 42 have substantially the same phase. That is, the high-frequency currents are distributed among the thin-film conductive layers 31 and 41, and the distributed currents flow with the same phase. This results in an increase in the effective skin depth.

Referring again to FIGS. 8A and 8B, the two resonators formed with the respective through-holes 2*a* and 2*b* are coupled to each other via capacitance between the open-end electrodes 5*a* and 5*b*. Similarly, the two resonators formed with the respective through-holes 2*c* and 2*d* are coupled to each other via capacitance between the open-end electrodes 5*c* and 5*d*. The coupling electrode 6*a* is capacitively coupled with the open-end electrode 5*a*, and the coupling electrode 6*c* is capacitively coupled with the open-end electrode 5*d*. The coupling electrode 6*b* is capacitively coupled with the open-end electrodes 5*b* and 5*c*. Thus, the dielectric duplexer according to the present embodiment functions as an antenna duplexer in which the signal input/output terminal 7*a* serves as an external terminal for connection with a transmitting circuit, the signal input/output terminal 7*b* serves as an external terminal for connection with an antenna, and the signal input/output terminal 7*c* serves as an external terminal for connection with a receiving circuit.

The structure of a dielectric duplexer according to a seventh embodiment is described below with reference to FIGS. 10A–10E.

FIGS. 10A, 10B, 10C, 10D, and 10E are a top view, a left side view, a right side vide, a rear view, and a front view, respectively, of the dielectric duplexer. Herein, the upper surface shown in FIG. 10A is a surface to be in contact with a mounting substrate.

As shown in FIGS. 10A and 10B, substantially parallel though-holes 2*a* to 2*f*, 8*a*, and 8*b* are formed in a dielectric block a having a generally rectangular shape. An inner conductor having a thin-film multilayer electrode structure is formed on the inner surface of each through-hole 2*a* to 2*f*, and a non-electrode part g is formed in a region near one open end of each through-hole 2*a* to 2*f* An outer conductor 4 having a thin-film multilayer electrode structure is formed on the four side faces, parallel to the axes of the through-holes, of the dielectric block 1. An outer conductor 4' in the form of a single-layer electrode is disposed on the two end faces, serving as short-circuited planes, of the dielectric block 1. Signal input/output terminals 7*a* and 7*b* are formed on one open end of each through-hole 8*a* and 8*b* such the signal input/output terminals 7*a* and 7*b* extend continuously from the inner conductor formed on the inner surface of the through-holes 8*a* and 8*b* to the end face and further to the upper surface of the dielectric block 1 and such that the signal input/output terminals 7*a* and 7*b* are isolated from the outer electrodes 4 and 4'. Furthermore, a signal input/output terminal 7*c* isolated from the outer conductor 4 is also formed on the outer surface of the dielectric block 1.

The two resonators formed with the through-holes 2*b* and 2*c* are coupled in a comb line fashion. The coupling line holes 8*a* and 8*b* are interdigitally coupled with the respective resonators formed with the through-holes 2*b* and 2*c*. The resonator formed with the through-hole 2*a* is interdigitally coupled with the coupling line hole 8*a*. Thus, a filter having a wide passband is formed with the two resonator stages consisting of the through-holes 2*b* and 2*c*, and a transmission filter is formed with this wide-band filter and a trap resonator realized by the through-hole 2*a*. Three resonators formed with the through-holes 2*d*, 2*e*, and 2*f* are coupled in a comb line fashion. The coupling line hole 8*b* is interdigitally coupled with the resonator formed with the through-hole 2*d*. The signal input/output terminal 7*c* is capacitively coupled with the resonator formed with the through-hole 2*f*. Thus, a reception filter having a band-pass characteristic is formed with the three resonators realized by the through-holes 2*d*, 2*e*, and 2*f*.

Thus, the dielectric duplexer according to the present embodiment functions as an antenna duplexer in which the signal input/output terminal 7*a* serves as an external terminal for connection with a transmitting circuit, the signal input/output terminal 7*b* serves as an external terminal for connection with an antenna, and the signal input/output terminal 7*c* serves as an external terminal for connection with a receiving circuit.

Examples of the structures of a dielectric filter and a dielectric duplexer according to an eighth embodiment are described with reference to FIGS. 11A and 11B.

Figure 11A:
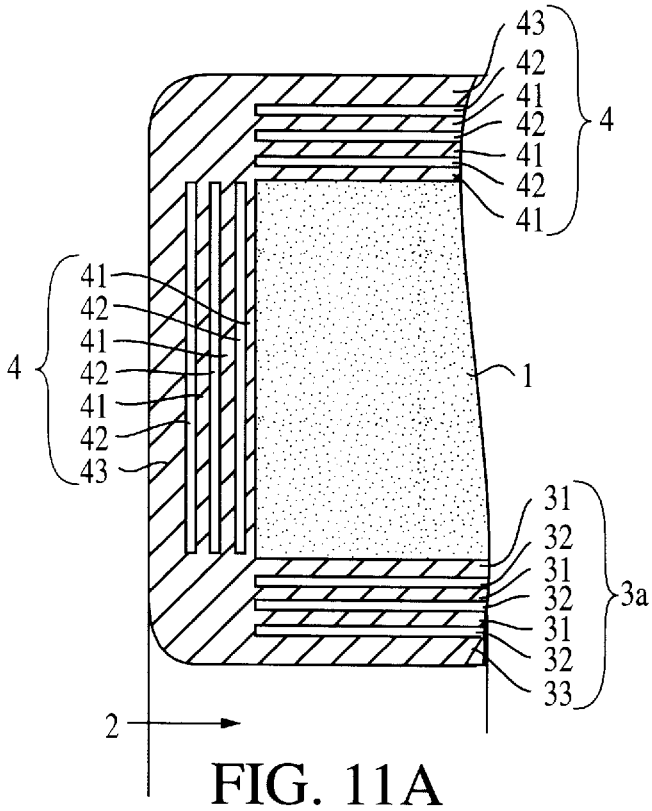
FIGS. 11A and 11B are cross-sectional views illustrating two examples of structures of a dielectric filter and a dielectric duplexer according to an eighth embodiment of the present invention.
Figure 11B:
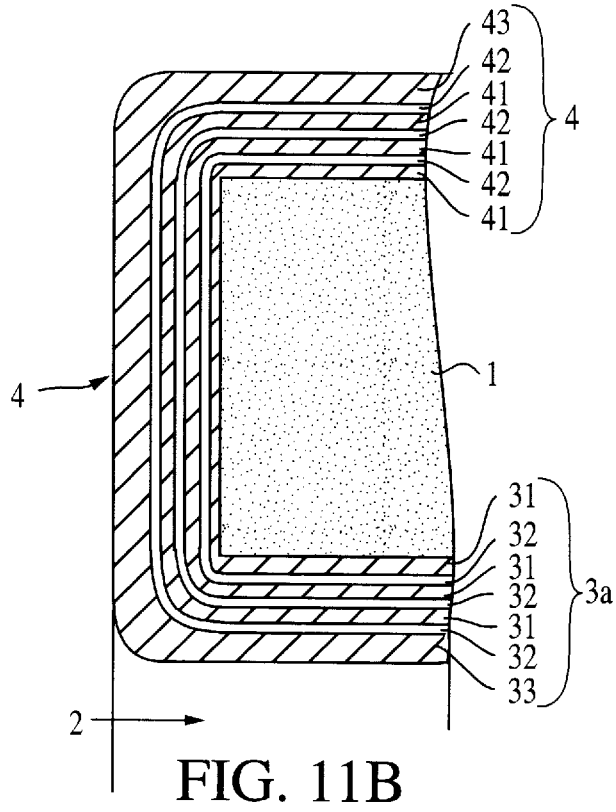

FIGS. 11A and 11B are enlarged cross-sectional views illustrating parts of dielectric blocks of a dielectric filter or a dielectric duplexer. In FIGS. 11A and 11B, the cross-sectional structure of a short-circuited end part, similar to the part denoted by C in FIG. 3 or 7, of a dielectric block is shown. The structures of an inner conductor 3*a* formed on the inner surface of a through-hole 2 and an outer conductor 4 formed on outer side face of the dielectric block 1 are similar to those shown in FIG. 3 or 7.

In the example shown in FIG. 11A, a thin-film multilayer electrode including thin-film conductive layers 41 and thin-film dielectric layers 42, which are alternately arranged in a multilayer structure, and an outermost conductive layer 43 is formed on the short-circuited end face of the dielectric block 1. At the comer portion between the inner conductor 3*a* and the thin-film multilayer electrode structure and also at the comer portion between the outer conductor 4 and the thin-film multilayer electrode structure, the respective thin-film conductive layers including the outermost conductive layers are electrically connected together via a single-layer electrode.

As a result of connecting together the respective conductive layers of the thin-film multilayer electrodes at the short-circuited end, the respective thin-film conductive layers have a common potential of zero, and high-frequency currents flowing through the respective thin-film conductive layers have the same phase. Thus, as in the first embodiment, the effective skin depth is increased. Because the outer electrode 4 on the short-circuited end face also has the thin-film multilayer electrode structure, the current is distributed among the thin-film conductive layers of the outer conductor 4 on the short-circuited end face, and thus the conductor loss at the short-circuited end face is sufficiently reduced.

In the example shown in FIG. 11B, the inner conductor 3*a* on the inner surface of the through-hole 2, the outer conductor 4 on the outer surface of the dielectric block 1, and the outer conductor 4 on the short-circuited end face are all formed with a continuous electrode having a thin-film multilayer structure. Also in this structure, the high frequency currents flowing through the respective thin-film conductive layers have substantially the same phase, and the effective skin depth is increased. Furthermore, the current is distributed among the thin-film conductive layers of the outer conductor 4 on the short-circuited end face, and thus the conductor loss at the short-circuited end face is also sufficiently reduced.

Figure 12:
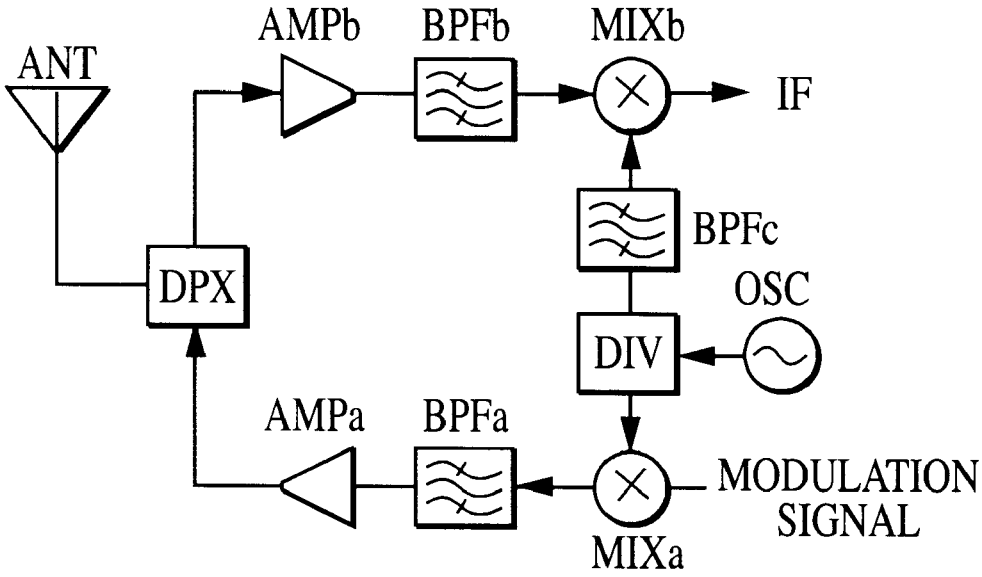
FIG. 12 is a block diagram illustrating the configuration of a communication device according to a ninth embodiment of the present invention.

The configuration of a communication device using a dielectric filter or a dielectric duplexer according to any of the above-described embodiments is described below with reference to FIG. 12. As shown in FIG. 12, the communication device includes a transmission/reception antenna ANT, a duplexer DPX, band-pass filters BPFa, BPFb, and BPFc, amplifiers AMPa and AMPb, mixers MIXa and MIXb, an oscillator OSC, and a frequency divider (synthesizer) DIV. The mixer MIXa modulates the frequency signal output from the frequency divider DIV in accordance with a modulation signal. The band-pass filter BPFa passes only signal components within the transmission frequency band. The amplifier AMPa amplifies the power of the signal output from the band-pass filter BPFa. The amplified signal is supplied to the antenna ANT via the duplexer DPX and transmitted from the antenna ANT. The amplifier AMPb amplifies a signal output from the duplexer DPX. The band-pass filter BPFb passes only signal components within the reception frequency band. The mixer MIXb mixes the frequency signal output from the band-pass filter BPFc with the received signal and outputs an intermediate frequency signal IF.

A dielectric duplexer having any one of the structures shown in FIGS. 8A–8D, 10A–10E and 11A–11B, may be employed as the duplexer DPX shown in FIG. 12. A dielectric filter having any one of the structures shown in FIGS. 1A–7C and 11A–11B may be employed as the band-pass filters BPFa, BPFb, and BPFc. Thus, a communication device having a small total size and having a low loss is realized.

In the embodiments described above, electrodes are formed on the inner and outer surfaces of a single dielectric block having a rectangular shape. Alternatively, a dielectric resonator, a dielectric filter, or a dielectric duplexer, having a similar structure, may be produced by adhesively combining two or more dielectric blocks having electrodes formed at particular locations. The thin-film multilayer electrodes may be produced by alternately forming conductive layers and dielectric layers into a multilayer structure by means of a physical or chemical film deposition technique such as sputtering, vacuum evaporation, CVD, laser abrasion, or ion plating.

As described above, the present invention provides great advantages. That is, in an aspect of the present invention, at least a part of at least one of the inner conductor and the outer conductor has the thin-film multilayer electrode structure formed by alternately disposing thin-film conductive layers with a thickness smaller than the skin depth at the operating frequency and thin-film dielectric layers with a particular dielectric constant, thereby increasing the effective cross-sectional areas of the inner and outer conductors and thus reducing the conductor losses. This allows a dielectric resonator, a dielectric filter, and a dielectric duplexer, having a low-loss characteristic, to be realized. Furthermore, a communication device having a small size and a high power efficiency can also be realized.

Furthermore, in another aspect of the present invention, a through-hole is formed between two opposing end faces of a dielectric block, wherein one of the two opposing end faces of the dielectric block acts as an open-circuited end face and the other end face acts as a short-circuited end face. The short-circuited end face is covered with an outer conductor a having a single-layer electrode structure with a thickness greater than the skin depth at the operating frequency. The outer conductor disposed on side faces other than the short-circuited end face has the thin-film multilayer electrode structure. Thus, in the dielectric resonator having the short-circuited end face, the currents flowing though the respective thin-film conductive layers of the thin-film multilayer electrode have the same phase. As a result, a low-loss characteristic can be achieved because of the distribution of current among the thin-film conductive layers.

Furthermore, in still another aspect of the present invention, a plurality of through-holes are formed in a dielectric block, and inner conductors are formed on the inner surfaces of the through-holes such that the parts of the inner conductors where they are closest to each other have the thin-film multilayer electrode structure. In this structure, because the thin-film multilayer electrodes are provided at the location where the currents are concentrated, the insertion loss of the dielectric filter is efficiently improved.

Although the present invention has been described in relation to particular embodiments thereof, many other variations and modifications and other uses will become apparent to those skilled in the art. Therefore, the present invention is not limited by the specific disclosure herein.

What is claimed is:

1. A TEM mode dielectric resonator comprising:

a dielectric block;

an inner conductor formed on the inner surface of a through-hole extending from one end face to the opposite end face of said dielectric block; and an outer conductor formed on the outer surface of said dielectric block, wherein at least a part of at least one of said inner conductor and said outer conductor has a thin-film multilayer electrode structure formed by alternately disposing thin-film conductive layers each having a thickness smaller than the skin depth at an operating frequency and thin-film dielectric layers, the thickness of the each thin-film dielectric layer is such that the phase velocity of TEM waves propagating through the dielectric block and the thin film dielectric layers all are substantially equal.

2. A dielectric resonator according to claim 1, wherein said outer conductor has said thin-film multilayer electrode structure.

3. A dielectric resonator according to claim 1, wherein said inner conductor has said thin-film multilayer electrode structure.

4. A dielectric resonator according to claim 1, wherein said one end face is formed so as to act as an open-circuited end face and said opposite end face is formed so as to act as a short-circuited end face, a first part of said outer conductor on said short-circuited end face has a single-layer electrode structure, and a second part of the outer conductor other than said first part on said short-circuited end face has said thin-film multilayer electrode structure.

5. A dielectric resonator according to claim 4, wherein said first part of the outer conductor on said short-circuited end face has a thickness equal to or greater than 3 times the skin depth at said operating frequency.

6. A dielectric resonator according to claim 1, wherein said through-hole includes a small-diameter part having a small hole diameter and a large-diameter part having a large hole diameter.

7. A TEM mode dielectric filter comprising:

a dielectric block;

an inner conductor formed on the inner surface of a through-hole extending from one end face to the opposite end face of said dielectric block; and an outer conductor formed on the outer surface of said dielectric block, wherein at least a part of at least one of said inner conductor and said outer conductor has a thin-film multilayer electrode structure formed by alternately disposing thin-film conductive layers each having a thickness smaller than the skin depth at an operating frequency and thin-film dielectric layers, the thickness of the each thin-film dielectric layer is such that the phase velocity of TEM waves propagating through the dielectric block and the thin film dielectric layers all are substantially equal; and external terminals coupled to said inner conductor for serving as high-frequency signal input/output terminals disposed on the outer surface of said dielectric block.

8. A TEM mode dielectric filter comprising:

a dielectric block;

a plurality of resonators each comprising an inner conductor formed on the inner surface of a through-hole extending from one end face to the opposite end face of said dielectric block; and an outer conductor formed on the outer surface of said dielectric block, wherein at least a part of at least one of said inner conductor and said outer conductor has a thin-film multilayer electrode structure formed by alternately disposing thin-film conductive layers each having a thickness smaller than the skin depth at an operating frequency and thin-film dielectric layers, the thickness of the each thin-film dielectric layer is such that the phase velocity of TEM waves propagating through the dielectric block and the thin film dielectric layers all are substantially equal; and external terminals each coupled to a respective one of said inner conductors for serving as input/output terminals disposed on the outer surface of said dielectric block.

9. A dielectric filter according to claim 8, wherein, of the inner conductors formed on the inner surfaces of adjacent through-holes, closest parts of said inner conductors have said thin-film multilayer electrode structure.

10. A dielectric duplexer comprising:

a first dielectric filter and a second dielectric filter, each being a dielectric filter according to one of claims 7 to 9;

an external terminal connected to one external terminal of each of said first and second filters for connection with an antenna;

an external terminal connected to another external terminal of said first filter for connection with a receiving circuit; and an external terminal connected to another external terminal of said second filter for connection with a transmitting circuit, said external terminals being disposed on the outer surface of said dielectric block.

11. A communication device including a dielectric duplexer according to claim 10;

a transmitting circuit; and a receiving circuit;

said transmitting circuit and said receiving circuit being connected respectively to said external terminals of said duplexer for connection with a transmitting circuit and a receiving circuit.

12. A communication device including a dielectric filter according to one of claims 7 to 9; and a high-frequency circuit comprising at least one of a transmitting circuit and a receiving circuit connected to one of said external terminals.

* * * * *